US006618896B1

(12) United States Patent
Nerger

(10) Patent No.: US 6,618,896 B1
(45) Date of Patent: Sep. 16, 2003

(54) APPARATUS FOR CLEANING OF CURVED SURFACES EMPLOYING THE CLOTH PRINCIPLE

(75) Inventor: Reinhard Nerger, Radebeul (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 09/407,192

(22) Filed: Sep. 28, 1999

(30) Foreign Application Priority Data

Nov. 2, 1998 (DE) ..... 198 50 410

(51) Int. Cl.[7] ..... B41F 35/00

(52) U.S. Cl. ..... 15/256.51; 101/423; 101/425; 242/538.1; 242/540; 242/543

(58) Field of Search ..... 15/256.51, 256.5, 15/256.53, 256.52; 101/423, 425, 416.1, 424; 242/538.1, 540, 541.3, 564, 543, 538

(56) References Cited

U.S. PATENT DOCUMENTS 4,344,361 A * 8/1982 MacPhee et al. ..... 15/256.51
5,069,128 A * 12/1991 Hara et al. ..... 15/256.51
5,125,342 A * 6/1992 Hara ..... 15/256.51
5,198,243 A * 3/1993 Shimizu et al. ..... 15/256.51
5,275,104 A * 1/1994 Corrado et al. ..... 15/256.53
5,328,116 A * 7/1994 Hishinuma ..... 242/543
5,390,602 A * 2/1995 Gorl ..... 101/425
5,404,819 A * 4/1995 Hishinuma et al. ..... 15/256.51
5,636,570 A * 6/1997 Ebina et al. ..... 101/424
5,894,800 A * 4/1999 Bar et al. ..... 15/256.51

FOREIGN PATENT DOCUMENTS

DE 3005469 * 10/1980

* cited by examiner

*Primary Examiner*—Gary K. Graham
(74) *Attorney, Agent, or Firm*—Goodwin Procter LLP

(57) ABSTRACT

Apparatus for cleaning a curved surface by employing the cloth principle, the apparatus having a roll for unsoiled cloth with unused cleaning cloth thereon, a roll for soiled cloth for taking up used soiled cloth, a pressing element for pulling unsoiled cleaning cloth off the roll for unoiled cloth and to bring it in contact with a surface to be cleaned by a movement of the element toward the surface, and means for pulling cleaning cloth off the roll for unsoiled cloth and for rolling soiled cloth up on the roll for soiled cloth by rolling up a part of the cleaning cloth that is longer or equal to the part thereof that is removed by the pressing element from the roll for unsoiled cloth independently of the respective diameters of the rolls for soiled and unsoiled cloth.

5 Claims, 1 Drawing Sheet

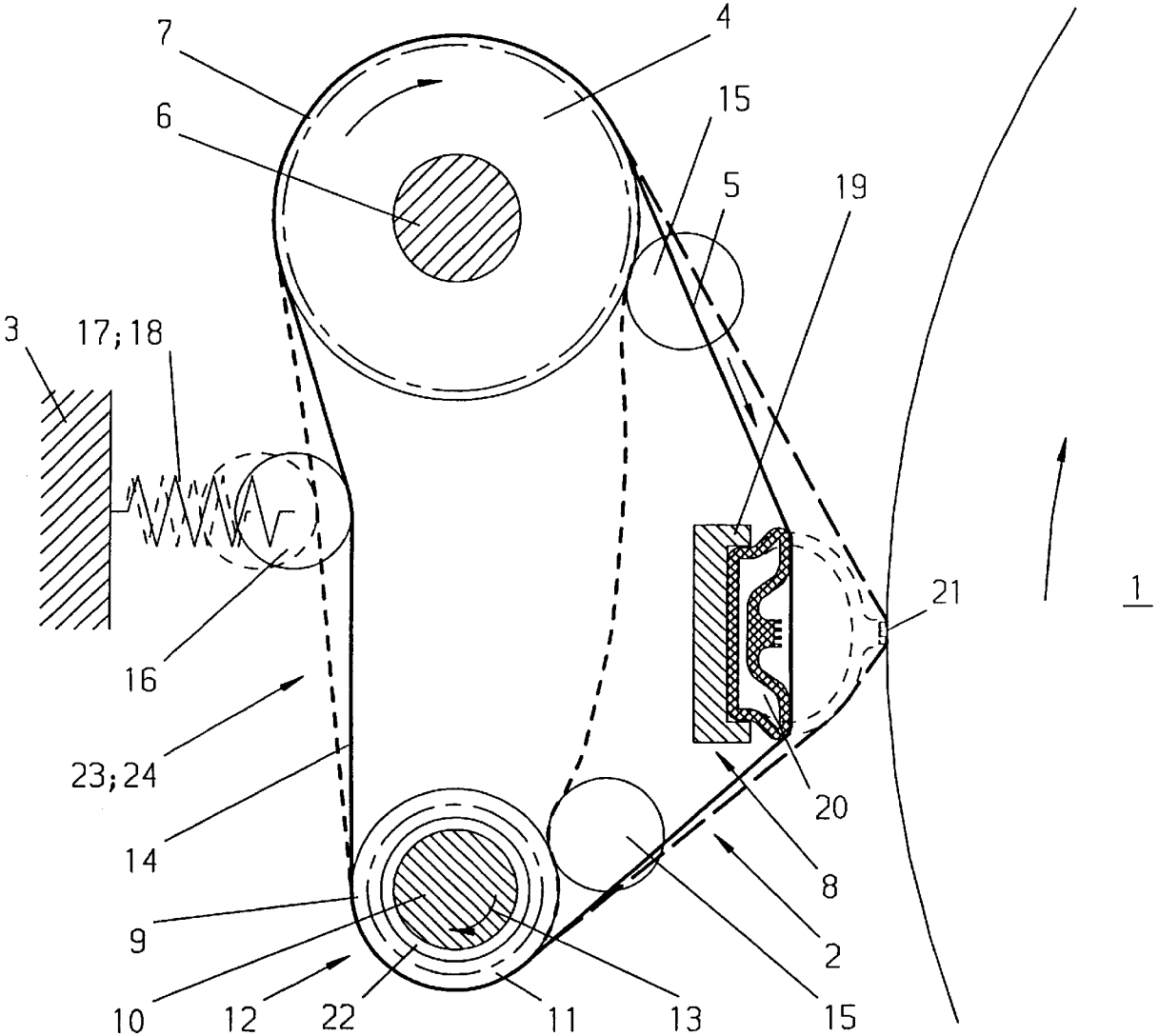
1
21
19
20
8
2
15
4
15
5
13
11
22
12
10
9
14
23;24
16
17;18
3
6
7

APPARATUS FOR CLEANING OF CURVED SURFACES EMPLOYING THE CLOTH PRINCIPLE

FIELD OF INVENTION

The invention relates to apparatus for cleaning of curved surfaces employing the cloth principle.

BACKGROUND

It is known e.g. from German patent No. 300 5469-02 in apparatus for cleaning by employing the cloth principle that the cleaning cloth is brought in operating contact with the surface to be cleaned by a pressing element having an elastic rubber membrane. This rubber membrane can be expanded by a pressure medium and the cleaning cloth is guided to the surface that is to be cleaned.

It is also known to design the pressing element for the cloth as a functional unit and to provide the side pointing to the surface to be cleaned with an elastic build-up. This pressing element can be slid by a pneumatic actuator and can be so engaged to or disengaged from the corresponding surface to be cleaned.

These kinds of cleaning apparatus have means to pull off the cleaning cloth from the roll for the unsoiled cloth, as well as means to roll up dirty cleaning cloth on the roll for the soiled cloth. These kinds of apparatus also are provided with means to insure that a constant cleaning cloth length is pulled off from the roll for the unsoiled cloth. For this purpose, for example according to the aforesaid German patent No. 300 5469-C2 the diameter of the roll for the soiled cloth is sensed and a mechanical control limits the rotational angle of the driven roll for the soiled cloth as a function of that diameter.

It is also known to use angular encoders at the cloth rolls to provide identical cloth lengths and to retain identical cloth lengths for cleaning by pulling off and rolling up.

The systems for pulling off and rolling up the cloth, and for securing identical cloth lengths are usually quite costly, and require considerable space which is especially in the case of sheet fed offset presses not readily available.

BRIEF DESCRIPTION OF INVENTION

It is an object of the present invention to provide an apparatus for cleaning curved surfaces by the cloth principle with simple means and low space requirements.

Apparatus for cleaning a curved surface by employing the cloth principle, the apparatus having a roll for unsoiled cloth with unused cleaning cloth there, a roll for soiled cloth for taking up used soiled cloth, a pressing element for pulling unsoiled cleaning cloth off the roll for unsoiled cloth and to bring it in contact with a surface to be cleaned by a movement of the element toward the surface, and means for pulling cleaning cloth off the roll for unsoiled cloth and for rolling soiled cloth that is longer or equal to the part thereof that is removed by the pressing element from the roll for unsoiled cloth independently of the respective diameters of the rolls for soiled and unsoiled cloth.

The solution of the present invention establishes by simple means equal cloth lengths rolls taken independently from the diameter of the roll of unsoiled cloth or the roll of soiled cloth and rolled up on the roll of soiled cloth. The pulling off of cleaning cloth with the pressing element furthermore permits space saving and cost reduction.

BRIEF DESCRIPTION OF THE DRAWING

The invention is described below in greater detail by reference to an embodiment of the invention, further by reference being had to the drawing, wherein:

FIG. 1 shows a schematic cross-sectional view of the cleaning apparatus.

DETAILED DESCRIPTION

FIG. 1 shows a cylinder 1 to be cleaned with a cleaning device 2. The cleaning device 2 can be provided with a frame 3, which contains all components, so that the entire cleaning device 2 can be taken off the press e.g. as a unit.

The cleaning device 2 has a roll 4 for unsoiled cloth with the unused cleaning cloth 5 would therearound. The roll 4 for unsoiled cloth is attached from a spindle 6, which is attached to a toothed belt pulley 7. The cleaning cloth 5 is guided from the roll 4 for unsoiled cloth past a pressing element 8 to a roll 9 for soiled cloth. The roll 9 for soiled cloth is attached from a spindle 10, which is connected to a toothed belt pulley 11 via a friction clutch 22. A locking mechanism 12 is allocated to the spindle 10 to permit the rotation of the spindle 10 and with it the roll 9 for soiled cloth in only one rotational direction 13. A toothed belt 14 connects the toothed belt pulley 7 and the toothed belt pulley 11. The toothed belt 14 is guided by guiding rolls 15 to correspond with the toothed belt pulley 7 and toothed belt pulley 11 respectively, and is tensioned by a tension roll 16 through force storage 17, which is supported from the frame 3. The force storage 17 is in the illustrated embodiment a compression spring 18.

The pressing element 8 has a base body 19 mounted from the frame 3 and carrying a pressure body 20 to be pressurized and depressurized by means not shown. The pressure body 20 when depressurized takes the position shown in solid lines in FIG. 1; and when it is pressurized, the pressure body 20 takes the position shown in broken lines. Once it is pressurized, the pressure body 20 provides the pressure area 21 with a big stroke.

It is also possible to design the pressing element 8 with an elastic zone pointing to the cylinder 1 to be cleaned and to stretch parallel along this cylinder 1. Actuators can move the pressing element 8 from the resting position into a working position, in which the cleaning cloth 5 is in operating contact with the surface of the cylinder 1.

During operation of the cleaning device 2 the pressure body 20 is shown depressurized in a resting position and the cleaning cloth 5, the toothed belt 14, the tension roll 16 as well as the pressure body 20 are shown in full lines in FIG. 1.

The pressure body 20 is pressurized if the cylinder 1 is to be cleaned and reaches the position shown in broken lines whereby the cleaning cloth 5 is pulled off from the roll 4 for unsoiled cloth. The locking mechanism 12 prevents removal of cleaning cloth 5 from the roll 9 for soiled cloth. The toothed belt pulley 7 is rotated together with the pulling off of the cleaning cloth 5 from the roll 4 for unsoiled cloth. The slack in the unloaded part of the toothed belt 14 increases as shown by broken lines, and the loaded part of the toothed belt 14 is tensioned because the toothed belt pulley 11 cannot follow the rotation of the driving toothed belt pulley 7 caused by the cleaning cloth 5. The tension roll 16 moves from the position shown in solid lines into the position shown in broken lines and the spring 18 is subjected to compression. When the pressure body 20 is depressurized, such as after the cleaning process is finished or an unsoiled cleaning cloth section is needed, the tension roll 16 is moved into its original position by the spring 18. This causes rotation of the soiled cloth roll 9 in the rotational direction 13 and a rolling up of the cleaning cloth 5 onto the roll 9 for soiled cloth. Simultaneously the slack of the unloaded part of the toothed belt 14 is eliminated. The friction clutch 22 is set to be engaged only when the cleaning cloth 5 that is to be rolled up is tightly stretched.

The speed increasing ratio from the toothed pulley 7 driven by the roll 4 for unsoiled cloth to the toothed belt pulley 11 driving the roll 9 for soiled cloth is selected so that it should roll up more or respectively exact the same length of the cleaning cloth 5 onto the roll 9 for soiled cloth as is taken from the roll 4 for unsoiled cloth, by the pressing element 8 independently of the diameter ratio of the roll 4 for unsoiled cloth. This also causes storage of always more energy in the compression spring 18 than is needed for rolling up of the roll 9 for soiled cloth. This also insures that the cleaning cloth 5 is always tightly stretched, whereby the friction clutch 22 is engaged only if an appropriate tension of the cleaning cloth 5 occurs. Thus, a pre-determined tension is achieved in the compression spring 18 after each transport of the cleaning cloth 5.

The connection between the roll 4 for unsoiled cloth and the roll 9 for soiled cloth is shown in the embodiment with a toothed belt drive. It is also possible to use any other kind of belt or belt-like transmission means.

What is claimed is:

1. Apparatus for cleaning a curved surface, which comprises a roll for unsoiled cloth with unused cleaning cloth thereon, a roll for soiled cloth for taking up soiled cloth, a pressing element being the sole means provided for pulling unsoiled cleaning cloth off said roll for unsoiled cloth and to bring it in contact with a curved surface to be cleaned by a movement of said element toward said surface, and means for rolling soiled cloth up on the roll for soiled cloth by rolling up a part of said cleaning cloth that is longer or equal to the part thereof that is removed by said pressing element from said roll for unused cleaning cloth independently of the respective diameters of said rolls for unused and soiled cloth.

2. The apparatus of claim 1, wherein said pressing element has a fixed base element and an optionally pressurizable and depressurizable pressure element.

3. The apparatus of claim 7, wherein said pressure element can be moved from a resting position into an operating position toward the surface to be cleaned, said pressure element being the only means in the apparatus for pulling unused cleaning cloth from said roll with unused cleaning cloth.

4. The apparatus of claim 4, wherein said means for rolling soiled cloth up on the roll for soiled cloth comprises a toothed transmission belt.

5. The apparatus of claim 4, further comprising a first spindle for carrying said roll for unsoiled cloth, a second spindle for carrying said roll for soiled cloth, a toothed belt pulley each attached to said first and said second spindles, said toothed belt pulley on said second spindle having a friction clutch associated therewith for enabling only unidirectional rotation of said second spindle, and said toothed transmission belt is wound about each of said toothed belt pulleys, guiding rolls for said toothed transmission belt, said rolls each corresponding to a respective toothed belt pulley, and a tension roll with force storage, said toothed transmission belt having an unloaded part guided by a guiding roll, and a loaded part tensioned by said tension roll with force storage.

* * * * *